US007205969B2

(12) United States Patent
Song

(10) Patent No.: US 7,205,969 B2
(45) Date of Patent: Apr. 17, 2007

(54) LIQUID CRYSTAL DISPLAY USING SWING COMMON ELECTRODE VOLTAGE AND A DRIVE METHOD THEREOF

(75) Inventor: Jang-Kun Song, Seoul (KR)

(73) Assignee: Samsung Electronics Co., Ltd. (KR)

( * ) Notice: Subject to any disclaimer, the term of this patent is extended or adjusted under 35 U.S.C. 154(b) by 142 days.

(21) Appl. No.: 09/947,714

(22) Filed: Sep. 7, 2001

(65) Prior Publication Data

US 2002/0101415 A1 Aug. 1, 2002

(30) Foreign Application Priority Data

Dec. 18, 2000 (KR) ..... 2000-77920

(51) Int. Cl.
*G09G 3/36* (2006.01)

(52) U.S. Cl. ..... 345/87; 345/94

(58) Field of Classification Search ..... 345/87, 345/90, 92, 94–96, 99, 100, 103
See application file for complete search history.

(56) References Cited

U.S. PATENT DOCUMENTS 5,754,266 A * 5/1998 Ohta et al. ..... 349/139
5,926,161 A * 7/1999 Furuhashi et al. ..... 345/100
6,166,714 A * 12/2000 Kishimoto ..... 345/96
6,313,818 B1 * 11/2001 Kondo et al. ..... 345/89
6,433,764 B1 * 8/2002 Hebiguchi et al. ..... 345/87
6,522,379 B1 * 2/2003 Ishihara et al. ..... 349/139
7,068,330 B2 * 6/2006 Song et al. ..... 349/39

* cited by examiner

*Primary Examiner*—Jimmy H. Nguyen
(74) *Attorney, Agent, or Firm*—F. Chau & Associates

(57) ABSTRACT

Disclosed is a liquid crystal display using a swing common electrode voltage and a drive method thereof. The liquid crystal display comprises a timing controller, a data driver, a gate driver outputting gate drive voltages and a drive voltage generator for outputting at least two different common electrode voltages that undergo swinging by synchronizing to a predetermined period with respect to the gate drive voltages. In the method, image signals are received from an external image signal source and supplied to the data lines. Scanning signals are supplied sequentially to the gate lines. Pixel voltage variations are checked. A common electrode voltage ending at positive is output during a gate "on" time to the LCD panel, and A common electrode voltage that repeatedly swings from negative to positive is generated during a gate "off" time if the pixel voltage has varied from negative to positive. A common electrode voltage ending at positive is generated during a gate "on" time to the LCD panel. A common electrode voltage that repeatedly swings from positive to negative is generated during a gate "off" time to the LCD panel if the pixel voltage is varied from positive to negative.

19 Claims, 9 Drawing Sheets

Fig. 2 PRIOR ART

| | (+)→(-) INVERSION | (-)→(+) INVERSION |
|---|---|---|
| pulse signals supplied to a storage common voltage line | | |
| ▫ PERMITTIVITY<br>- LARGE→SMALL<br>▫ Voltage<br>- High→Low<br>▫ Gray<br>- Low→High | 10V 5V 0V<br>an effect of approaching a data signal to a COM signal | 10V 5V 0V<br>an effect of approaching a data signal to a COM signal |
| ▫ PERMITTIVITY<br>- SMALL→LARGE<br>▫ PERMITTIVITY<br>- Low→High<br>▫ PERMITTIVITY<br>- High→Low | 10V 5V 0V<br>data voltage overshoots a normal signal value | 10V 5V 0V<br>data voltage overshoots a normal signal value |

LIQUID CRYSTAL DISPLAY USING SWING COMMON ELECTRODE VOLTAGE AND A DRIVE METHOD THEREOF

BACKGROUND OF THE INVENTION (a) Field of the Invention

The present invention relates to a liquid crystal display and a drive method thereof. More particularly, the present invention relates to a liquid crystal display and a drive method thereof in which swinging of a common electrode voltage is performed by synchronizing the voltage with a gate pulse, thereby generating an overshoot to improve a response speed of liquid crystal material.

(b) Description of the Related Art

In recent times, there has been an ever-increasing need for lighter and thinner displays. Accordingly, the liquid crystal display (LCD) is replacing the CRT in many applications such as in television and as displays for personal computers.

LCDs include first and second substrates provided substantially in parallel with a predetermined gap therebetween, and liquid crystal material is sandwiched between the two opposing substrates. A voltage is applied to the liquid crystal material, which has a dielectric anisotropy, to form an electric field between the substrates. By varying the strength of the electric field, the alignment of liquid crystal molecules of the liquid crystal material is controlled to thereby control the transmittance of incident light. Although there are different types of LCDs, the most type is the thin film transistor (TFT) LCD.

FIG. 1 shows a pixel equivalent circuit of a conventional TFT-LCD. With reference to the drawing, a pixel of the TFT-LCD includes a TFT switching element in which a source terminal and a gate terminal are respectively connected to a data line and a gate line; a liquid crystal capacitor Clc and a storage capacitor Cst, each connected to a drain terminal of the TFT switching element; a parasitic capacitor Cgd provided between the gate terminal and the drain terminal; a parasitic capacitor Cds connected between the drain terminal and the source terminal; and an overlap capacitor (Cover) provided between the data line and a pixel electrode Vp.

The method of driving the liquid crystal material between the pixel electrode, which is provided on a TFT substrate, and a common electrode which is provided on a color filter substrate, will now be described.

First, if a positive pulse is applied through the gate line, the TFT switching element turns on. At this time, a signal voltage applied to a source electrode of the TFT switching element through a signal line is applied to the liquid crystal capacitor Clc and the storage capacitor Cst through the drain terminal. The signal voltage, which is applied together with a gate pulse, is continuously maintained even when a gate voltage is turned off and applied to the liquid crystal capacitor Clc. However, because of the parasitic capacitor Cgd between the gate terminal and the drain terminal, a pixel voltage undergoes a voltage level shift by a certain amount of voltage.

The biggest limitation in the TFT-LCD that is structured and operating as described above is its response speed. Matsushida Company improves a capacitive coupled driving (CCD) mechanism in order to increase the response speed of the TFT-LCD.

FIG. 2 shows a chart for describing the effects of CCD. A direction applied to a pixel for controlling overshooting and undershooting is determined by the liquid crystal property of low anisotropy. If a pulse is applied to a common electrode, an amount that undergoes capacitive coupling increases in the pulse direction of a low anisotropic state of the liquid crystal material. If a pulse in which the voltage is first increased then decreased is applied in the case where the direction applied to the common electrode inverts from positive (+) to negative (−), or if a pulse in which the voltage is increased then decreased is applied in the case where the direction applied to the common electrode inverts from negative (−) to positive (+), conversion from a high gray level to a low gray level occurs for a normal white mode. However, if conversion from the low gray level to the high gray level occurs, undershooting and overshooting of the voltage result such that the liquid crystal material rotates more quickly.

FIG. 3 shows a pixel equivalent circuit of a TFT-LCD using a previous gate disclosed by Matsushita Company, and FIG. 4 shows charts used to describe the increase in response speed for the TFT-LCD of FIG. 3.

With reference to the drawings, one end of a storage capacitor Cst is connected to a drain, and its other end is connected to a previous gate. During operation, a gate pulse is applied such that an average voltage Vp applied to the pixel results as shown in Equation 1.

$$Vp=+Vs+[Cst/(Cst+Cgd+Clc)]\Delta Vg \quad \text{[Equation 1]}$$

where Vs is a voltage applied to a source terminal, Cst is a capacitance of the storage capacitor Cst, Cgd is a parasitic capacitance between a gate terminal and a drain terminal, Clc is a capacitance of a liquid crystal capacitor, and ΔVg is a difference between a previous gate voltage and a present gate voltage.

However, the use of the previous gate in the TFT-LCD disclosed by Matsushida Company increases the gate load and can only be applied to line inversion driving. It also generates crosstalk and flicker to thereby make large-scale high resolution difficult. Also, a conventional gate tap IC is not able to be used in the Matsushida TFT-LCD. Further, if the gate voltage excessively increases when turned off in this prior TFT-LCD, an off current increases such that there is a limit to the degree at which a value of the gate can be changed.

As described above, in the TFT-LCD disclosed by Matsushita Company, although the use of a previous gate signal and the drive method of applying a gate signal in two steps significantly improves response speed, there are limits to the application to a large-scale high resolution LCD when considering the use of a previous gate, and line inversion.

SUMMARY OF THE INVENTION

The present invention has been made in an effort to solve the above problems.

It is an object of the present invention to provide a liquid crystal display and a drive method thereof that uses a dot inversion structure without modification, and a common electrode voltage is synchronized with a gate pulse to swing the common electrode voltage to generate an overshoot, thereby increasing a response speed of liquid crystal material.

To achieve the above object, the present invention provides a liquid crystal display using a swing common electrode voltage and a drive method thereof. The liquid crystal display comprises a timing controller for outputting data driver drive signals and gate driver drive signals, and outputting a first signal, which determines a period and an amplitude, according to externally-received signals including a vertical synchronization signal, a horizontal synchronization signal, and a main clock signal; a data driver which, according to the data driver drive signals, outputs data drive voltages for driving a polarity of liquid crystal capacitors; a gate driver which, according to the gate driver drive signals, outputs gate drive voltages; a drive voltage generator for receiving the first signal and either increasing or decreasing a voltage level of the first signal, and outputting at least two different common electrode voltages that undergo swinging by synchronizing to a predetermined period with respect to the gate drive voltages; and an LCD panel including (a) switching elements formed in regions defined by the crossing of gate lines and data lines and connected to the gate lines and the data lines, (b) the liquid crystal capacitors for transmitting a light according to an "on" operation of the switching element and in accordance to a pixel voltage that is in proportion to the swing common electrode voltages and the data drive voltages, and (c) storage capacitors for accumulating the data drive voltages when the switching element is on and applying the stored voltages to the liquid crystal capacitor when the switching element is off, the LCD panel being driven according to the data drive voltages and the gate drive voltages.

According to a feature of the present invention, each of the common electrode voltages output from the drive voltage generator ends at negative at a gate "on" time when the pixel voltage changes from negative to positive, ends at positive at a gate "on" time when the pixel voltage changes from positive to negative, and undergoes swinging of positive and negative after the gate is closed.

According to another feature of the present invention, the LCD panel further comprises a plurality of gate lines arranged horizontally, and a plurality of common electrode lines arranged between the gate lines, wherein a first terminal of the switching elements is connected to the gate lines and a second terminal of the switching elements is connected to the data lines; one end of the storage capacitors connected to a third terminal of the switching elements; and in the case where the liquid crystal capacitors are positioned at odd lines and odd columns, and at even lines and even columns within regions formed by the gate lines and the data lines, one end is connected to the third terminal of the switching elements and other ends are connected to the common electrode lines positioned at upper ends of the gate lines, and when the liquid crystal capacitors are positioned at odd lines and even columns, and at even lines and odd columns, one end is connected to the third terminal of the switching elements and other ends are connected to the common electrode lines adjacent to the gate lines positioned at the lower ends of the gate lines.

According to yet another feature of the present invention, the LCD panel comprises odd common electrode lines arranged horizontally; odd gate lines arranged adjacent to the odd common electrode lines; even common electrode lines arranged horizontally; even gate lines arranged adjacent to the even common electrode lines; odd data lines arranged vertically and even data lines arranged horizontally; a first storage capacitor for connecting the odd common electrode lines (or the even common electrode lines) to the odd gate lines (or the even gate lines) in regions divided by the odd data lines and the even data lines; and a second storage capacitor for connecting the even common electrode lines (or the odd common electrode lines) to the odd gate lines (or the even gate lines) in regions divided by the even data lines and the odd data lines.

According to still yet another feature of the present invention, the LCD panel comprises common electrode lines arranged horizontally between gate lines; a first pixel formed in a region formed by odd gate lines and even gate lines, and by odd data lines and even data lines, one end of the first pixel being connected to the odd gate lines and its other end being connected to the common electrode lines; a second pixel formed in a region formed by the odd gate lines and the even gate lines, and by the odd data lines and the even data lines, one end of the second pixel being connected to the even gate lines; a third pixel formed in a region formed by the odd gate lines and the even gate lines, and by the even data lines and the odd data lines, one end of the third pixel being connected to the odd gate lines; and a fourth pixel formed in a region formed by the odd gate lines and the even gate lines, and by the even data lines and the odd data lines, one end of the fourth pixel being connected to the common electrode lines and its other end being connected to the even gate lines.

According to still yet another feature of the present invention, the minimum two types of common electrode voltages supplied by the drive voltage generator are applied at leftward, rightward, or both ends of the common electrode lines.

According to still yet another feature of the present invention, a dot inversion drive method is used to drive the LCD panel.

According to still yet another feature of the present invention, the common electrode lines are arranged in an independent wiring configuration.

In another aspect, the present invention provides a liquid crystal display comprising an LCD panel, the LCD panel including (a) switching elements formed in regions defined by the crossing of gate lines and data lines and connected to the gate lines and the data lines, (b) liquid crystal capacitors for transmitting a light according to an "on" operation of the switching element and in accordance to a pixel voltage that is in proportion to swing common electrode voltages and data drive voltages, and (c) storage capacitors for accumulating the data drive voltages when the switching element is on and applying the stored voltages to the liquid crystal capacitors when the switching element is off, wherein a record signal voltage corresponding to display data is applied sequentially to each pixel to display an image of each frame, and wherein during driving of the pixels, each of the common electrode voltages output from the drive voltage generator ends at negative at a gate "on" time when the pixel voltage changes from negative to positive, ends at positive at a gate "on" time when the pixel voltage changes from positive to negative, and undergoes swinging of positive and negative after the gate is closed.

According to still yet another feature of the present invention, a swing width of the common electrode voltages is between 12 and 25 volts.

In another aspect, the present invention provides a drive method for a liquid crystal display, the liquid crystal display comprising an LCD panel, which includes (a) switching elements formed in regions defined by the crossing of gate lines and data lines and connected to the gate lines and the data lines, (b) liquid crystal capacitors for transmitting a light according to an "on" operation of the switching element and in accordance to a pixel voltage that is in proportion to swing common electrode voltages and data drive voltages, and (c) common capacitors for accumulating the data drive voltages when the switching element is on and applying the stored voltages to the liquid crystal capacitors when the switching element is off, the drive method comprising the steps of (a) receiving image signals from an external image signal source, and supplying the image signals to the data lines; (b) supplying scanning signals sequentially to the gate lines to control gate on/off operations of the switching element; (c) checking pixel voltage variations occurring according to the gate on/off operations of the switching elements; (d) outputting a common electrode voltage ending at positive during a gate "on" time to the LCD panel, and outputting a common electrode voltage that repeatedly swings from negative to positive during a gate "off" time if, in step (c), it is determined that the pixel voltage has varied from negative to positive; and (e) outputting a common electrode voltage ending at positive during a gate "on" time to the LCD panel, and outputting a common electrode voltage that repeatedly swings from positive to negative during a gate "off" time to the LCD panel if, in step (c), it is determined that the pixel voltage has varied from positive to negative.

According to a feature of the drive method of the present invention, a swing width of the common electrode voltage is between 12 and 25 volts.

According to another feature of the drive method of the present invention, the LCD panel is driven by a dot inversion method.

According to yet another feature of the drive method of the present invention, the LCD panel comprises a plurality of gate lines arranged horizontally; a plurality of data lines arranged vertically; a plurality of common electrode lines arranged between the gate lines, that is, arranged at an upper end of a first gate line and a lower end of a last gate line; a plurality of switching elements, a first terminal connected to the gate lines and a second terminal connected to the data lines; storage capacitors, one end of each connected to a third terminal of the switching elements; and liquid crystal capacitors in which, when positioned at odd lines and odd columns, and at even lines and even columns within regions formed by the gate lines and the data lines, one end is connected to the third terminal of the switching elements and other ends are connected to the common electrode lines positioned at upper ends of the gate lines, and in which, when positioned at odd lines and even columns, and at even lines and odd columns, one end is connected to the third terminal of the switching elements and other ends are connected to the common electrode lines adjacent to the gate lines positioned at the lower ends of the gate lines.

According to still yet another feature of the drive method of the present invention, the LCD panel comprises odd common electrode lines arranged horizontally; odd gate lines arranged adjacent to the odd common electrode lines; even common electrode lines arranged horizontally; even gate lines arranged adjacent to the even common electrode lines; odd data lines arranged vertically and even data lines arranged horizontally; a first storage capacitor for connecting the odd common electrode lines (or the even common electrode lines) to the odd gate lines (or the even gate lines) in regions divided by the odd data lines and the even data lines; and a second storage capacitor for connecting the even common electrode lines (or the odd common electrode lines) to the odd gate lines (or the even gate lines) in regions divided by the even data lines and the odd data lines.

According to still yet another feature of the drive method of the present invention, the LCD panel comprises common electrode lines arranged horizontally between gate lines; a first pixel formed in a region formed by odd gate lines and even gate lines, and by odd data lines and even data lines, one end of the first pixel being connected to the odd gate lines and its other end being connected to the common electrode lines; a second pixel formed in a region formed by the odd gate lines and the even gate lines, and by the odd data lines and the even data lines, one end of the second pixel being connected to the even gate lines; a third pixel formed in a region formed by the odd gate lines and the even gate lines, and by the even data lines and the odd data lines, one end of the third pixel being connected to the odd gate lines; and a fourth pixel formed in a region formed by the odd gate lines and the even gate lines, and by the even data lines and the odd data lines, one end of the fourth pixel being connected to the common electrode lines and its other end being connected to the even gate lines.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIG. 2 is a chart for describing the effects of CCD;

DETAILED DESCRIPTION OF THE PREFERRED EMBODIMENTS

Preferred embodiments of the present invention will now be described in detail with reference to the accompanying drawings.

Figure 1:
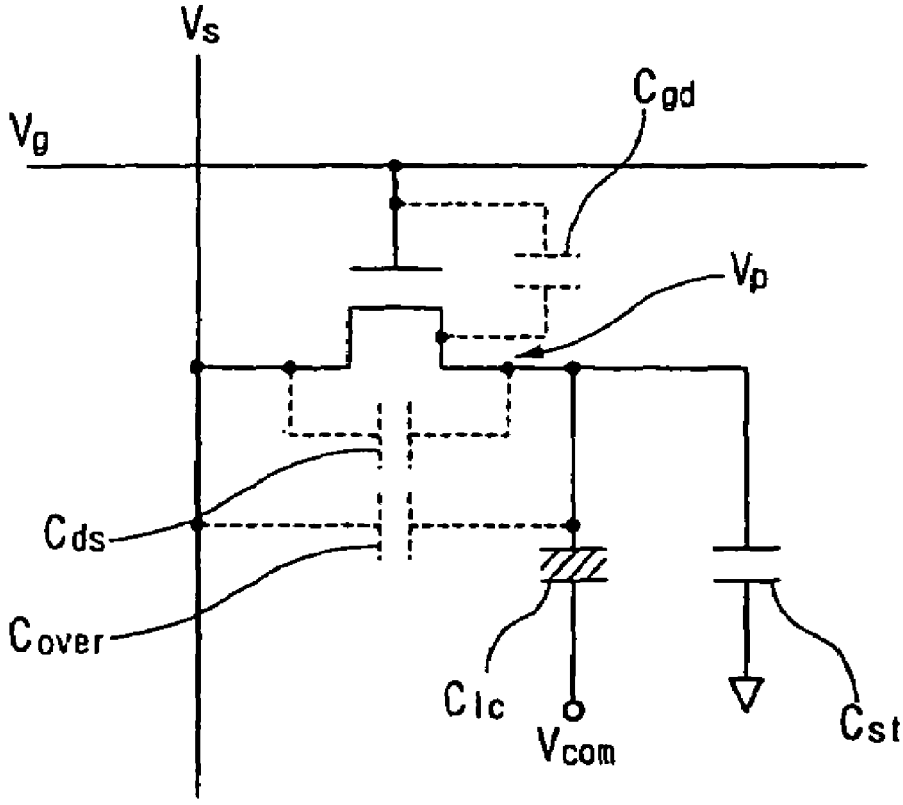
Fig. 1 PRIOR ART
FIG. 1 is a pixel equivalent circuit of a conventional TFT-LCD.
Figure 3:
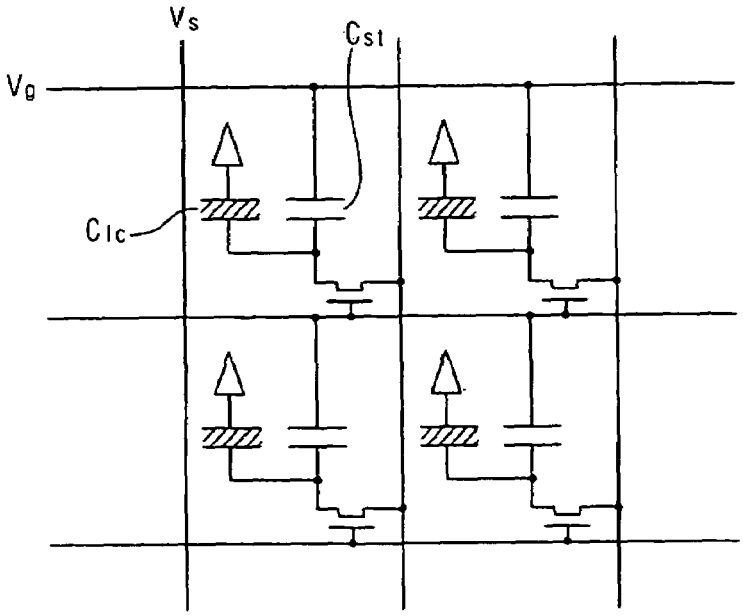
Fig. 3 PRIOR ART
FIG. 3 is a pixel equivalent circuit of a TFT-LCD using a previous gate disclosed by Matsushita Company.
Figure 4:
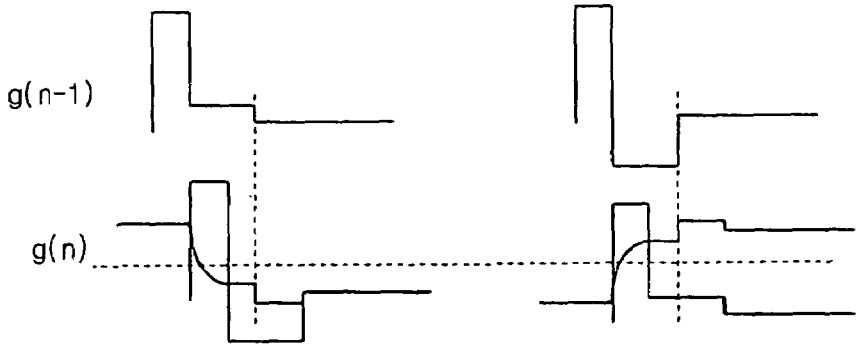
Fig. 4 PRIOR ART
FIG. 4 shows charts used to describe the increase in response speed for the TFT-LCD of FIG. 3.
Figure 5:
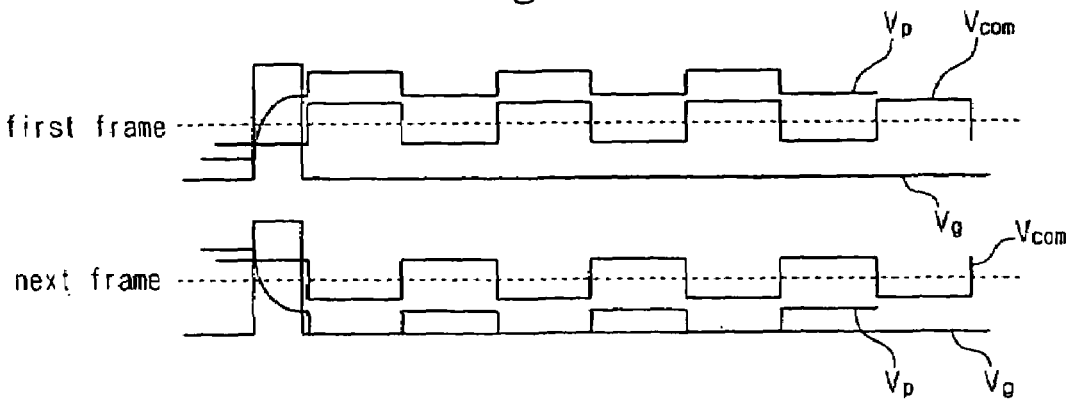
FIG. 5 shows waveform diagrams for illustrating variations in a pixel voltage occurring as a result of a periodic swing common electrode voltage according to a first preferred embodiment of the present invention.

FIG. 5 shows waveform diagrams for illustrating variations in a pixel voltage occurring as a result of a periodically swinging common electrode voltage according to a first preferred embodiment of the present invention.

With reference to the drawing, by swinging a common electrode voltage, swinging of voltages applied to a pixel is performed. An average voltage Vp applied to a pixel is as shown in Equation 2.

$$Vp=+Vs+\{Cst/[2(Cst+Cgd+Clc)]\}\Delta Vcom \quad \text{[Equation 2]}$$

where Vs is a voltage applied to a source terminal, Cst is a capacitance of a storage capacitor, Cgd is a parasitic capacitance between a gate terminal and a drain terminal, Clc is a capacitance of a liquid crystal capacitor, and ΔVcom is a swing width of a voltage applied to a common electrode line.

In Equation 2, since a voltage additionally applied to a common electrode is proportional to Cst/(Cst+Clc), when a gray level varies by memory effects resulting from the liquid crystal capacitor Clc, overshooting occurs such that a response speed of liquid crystal material increases. In order to increase the response speed of the liquid crystal material, that is, in order to apply the above method of generating overshoot to improve response speed, the following three conditions must be satisfied.

(i) When the pixel voltage changes from negative (−) to positive (+), the common electrode voltage ends at negative (−) at a gate "on" time.

(ii) When the pixel voltage changes from positive (+) to negative (−), the common electrode voltage ends at positive (+) at a gate "on" time.

(iii) After the gate is closed, swinging of positive (+) and negative (−) is repeatedly performed.

The degree of overshoot generated as a result of the liquid crystal capacitor Clc is determined as follows.

If each capacitance of the liquid crystal capacitor Clc is designated as Clc1 and Clc2, when changing to a second gray state from a first gray state, a difference in values of the second term on the right side of Equation 2 results in a value corresponding to overshoot as shown in Equation 3.

$$\begin{aligned} V_{overshoot} &= \left[Cst/2(Cst+Clc1)-Cst/2(Cst+Clc2)\right]\Delta Vcom \quad \text{[Equation 3]} \\ &= [\Delta Vcom\ \ Cst(Clc2-Clc1)]/[2(Cst+ \\ &\quad Clc1)(Cst+Clc2)] \end{aligned}$$

The amount of overshoot is a deciding factor in determining increases in response speed. Although variations in capacitance can be realized through design, the degree of such variations is limited by panel characteristics. Accordingly, to increase the amount of overshoot, the swing width ΔVcom of the common electrode voltage must be increased. However, when Vs in Equation 2 is 0, since the second term on the right side of the equation must be less than a critical voltage Vth of liquid crystals, the swing width ΔVcom of the common electrode voltage is limited. In particular, in a dot inversion drive method, when 0V is applied to the pixel, a voltage induced because of a swing of an independent common electrode voltage must be less than the critical voltage Vth of liquid crystals as follows.

$$Cst/[2(Cst+Cgd+Clc)]\Delta Vcom<Vth$$

From this inequality, it follows that the condition of ΔVcom<[2Vth(Cst+Cgd+Clc)]/Cst must be satisfied. Hence, the amount of overshoot in Equation 3 is limited. For example, if Clc2=Cst and Clc1=0.5Cst, it is possible to ignore Cgd, and if Vth=1.6V, a maximum overshoot value of 0.4V results in Equation 3.

Since this is a value that moves between 1 gray level and 64 gray levels, when moving between gray levels starting from a low gray level, the amount of overshoot is reduced. Also, with this value, it is not possible to reduce the response speed to under 16 msec over the entire range of gray levels. As a result, in order to realize a high-speed response using a swing multi common capacity, the overshoot of Equation 3 must be increased more.

Figure 6:
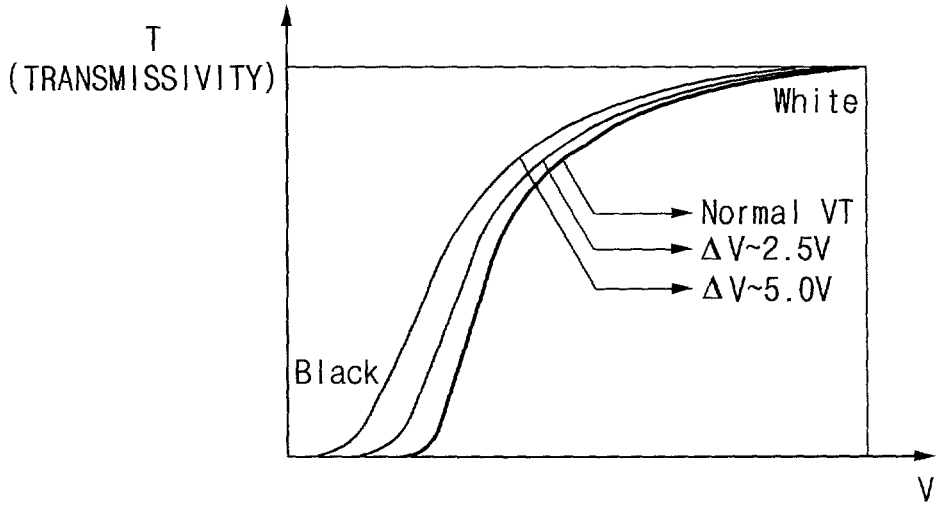
FIG. 6 is a graph showing changes in transmissivity and voltage according to an increase in a common electrode voltage swing width according to a first preferred embodiment of the present invention.

Reasons for the limitations in the swing width ΔVcom of the common electrode voltage in Equation 3 will be described with reference to FIG. 6. FIG. 6 is a graph showing changes in transmissivity and voltage according to increases in the common electrode voltage swing width.

As shown in the drawing, a normal VT curve results when swinging of a voltage of a common electrode is not performed, while the VT curve is moved to the left according to increases in the swing width ΔVcom of the common electrode voltage. This is a result of an additional voltage at Vs through a common swing (in addition to the voltage applied in Equation 2).

Accordingly, even with the application of an identical voltage, if the swing width ΔVcom of the common electrode voltage is large, the effective voltage applied to the pixel is increased such that the VT curve is shifted to the left in FIG. 6, in accordance with increases in the swing width ΔVcom of the common electrode voltage. In FIG. 6, ΔV is less than roughly 5V in a vertical alignment mode. If ΔV exceeds this level, a black value is unable to be obtained.

Figure 7:
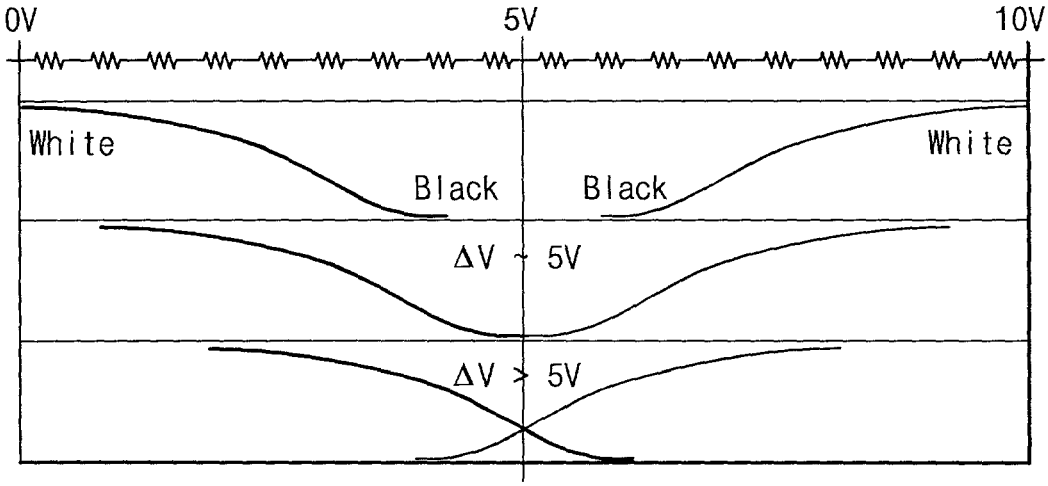
FIG. 7 is a graph showing a relation between a resistor array and a VT curve in a drive PCB according to a first preferred embodiment of the present invention.

FIG. 7 is a graph showing a relation between a resistor array and a VT curve in a drive PCB according to a first preferred embodiment of the present invention.

In the uppermost row of the graph (row 1), there is shown a resistor array for gray level expression in a control PCB. Negative (−) side VT curves and positive (+) side VT curves are shown in rows 2 through 4. Rows 2, 3 and 4 appear in this order under row 1. In normal drive of row 2 of FIG. 7, a left curve is a negative (−) side VT curve and a right curve is a positive (+) side VT curve. The drawn curves are drive voltages.

Row 3 of FIG. 7 shows a VT curve in the case where the swing width ΔV of the common electrode voltage Vcom is approximately 5V. As described above with reference to FIG. 6, this is the voltage used in conventional methods to obtain the largest overshoot. Here, black portions meet at a central area. However, in row 4 of FIG. 7, the VT curves cross. If the voltage is applied with this structure, the swing width ΔV of the common electrode voltage Vcom can be increased.

In the above method of the first preferred embodiment of driving the high voltage swing common electrode voltage, since there is a limit to the degree to which swinging of the common electrode voltage Vcom can be performed, the level of overshoot is small such that only minimal improvements in response speed are obtained. A method of improving increases to response speed (up to 4×), even with a swing width that is smaller than that realized in the first embodiment, will now be described.

Figure 8:
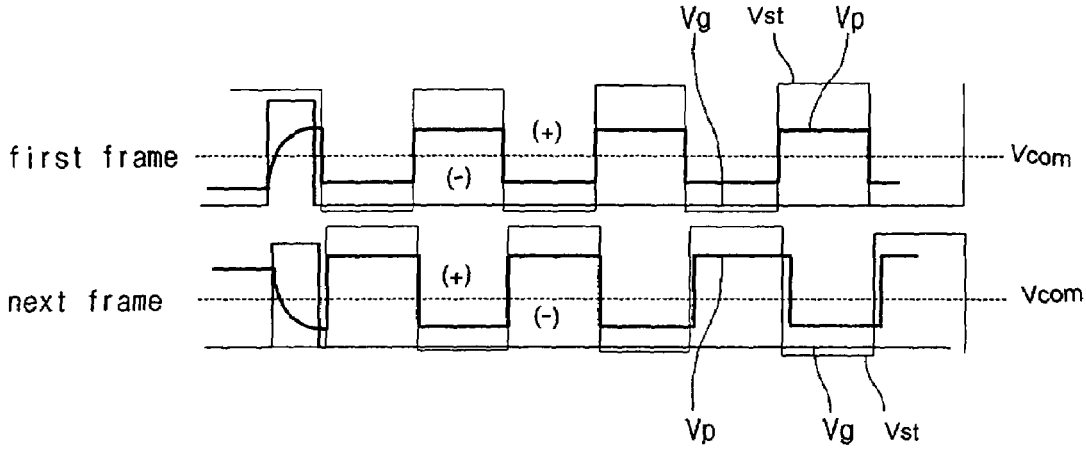
FIG. 8 shows waveform diagrams for illustrating variations in a pixel voltage occurring as a result of a periodic swing common electrode voltage according to a second preferred embodiment of the present invention.

FIG. 8 shows waveform diagrams for illustrating variations in a pixel voltage occurring as a result of a periodic swing common electrode voltage according to a second preferred embodiment of the present invention.

With reference to FIG. 8, voltages applied to one pixel swing a common electrode voltage such that the voltages applied to the pixel undergo swinging. At this time, an average voltage Vp applied to a pixel is as shown in Equation 2.

In Equation 2, since the voltage additionally applied to the common electrode is proportional to Cst/(Cst+Clc), when a gray level varies by memory effects resulting from the liquid crystal capacitor Clc, overshooting occurs such that the response speed of liquid crystal material increases. In order to increase the response speed of the liquid crystal material, that is, in order to apply the above method of generating overshoot to improve response speed, the following three conditions must be satisfied. In this case, a faster response speed than the first embodiment is realized.

(i) When the pixel voltage changes from negative (−) to positive (+), the common electrode voltage ends at positive (+) at a gate "on" time.

(ii) When the pixel voltage changes from positive (+) to negative (−), the common electrode voltage ends at negative (−) at a gate "on" time.

(iii) After the gate is closed, swinging of positive (+) and negative (−) is repeatedly performed.

With reference to FIGS. 5 and 8, in the first and second preferred embodiments, the common electrode voltages undergo swinging and are inverted.

Figure 9:
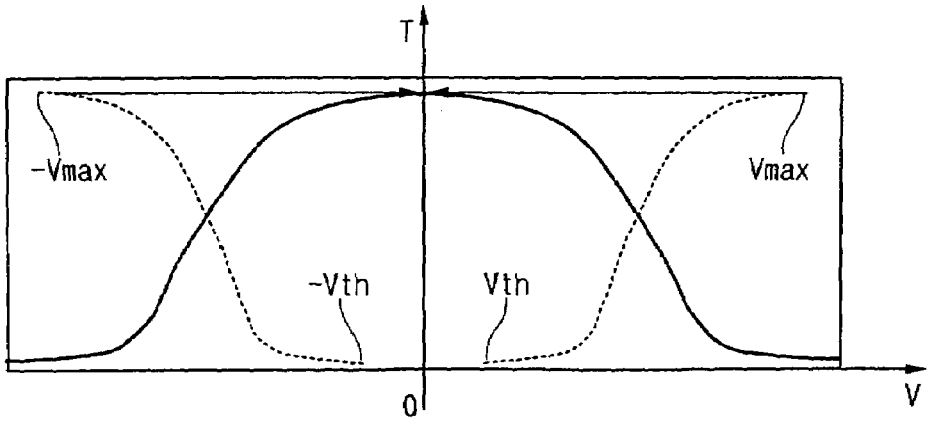
FIG. 9 is a graph showing changes in transmissivity and voltage according to an increase in a common electrode voltage swing width according to a second preferred embodiment of the present invention.

FIG. 9 is a graph showing changes in transmissivity and voltage according to an increase in a common electrode voltage swing width according to the second preferred embodiment of the present invention. In FIG. 9, a VT curve undergoes a shift as a result of the shift in the common electrode voltage.

With reference to the drawing, if a positive (+) voltage is applied when a data voltage is applied, a negative (−) voltage is applied to the pixel. However, if a negative (−) voltage is applied when the data voltage is applied, a positive (+) voltage is applied to the pixel. Further, switching from a normally black mode to a normally white mode occurs.

To obtain such effects, the swing width ΔVcom of the common electrode voltage, which is applied to a common electrode of an independent wiring structure and to a common electrode line, must be between 12V and 25V, and preferably 18V. An internal structure of an LCD panel and a pixel structure to realize an increase in the swing width of the common electrode voltage to 18V or higher will now be described. In particular, an example of dividing the common electrode line into three types to drive the same will be described.

Figure 10:
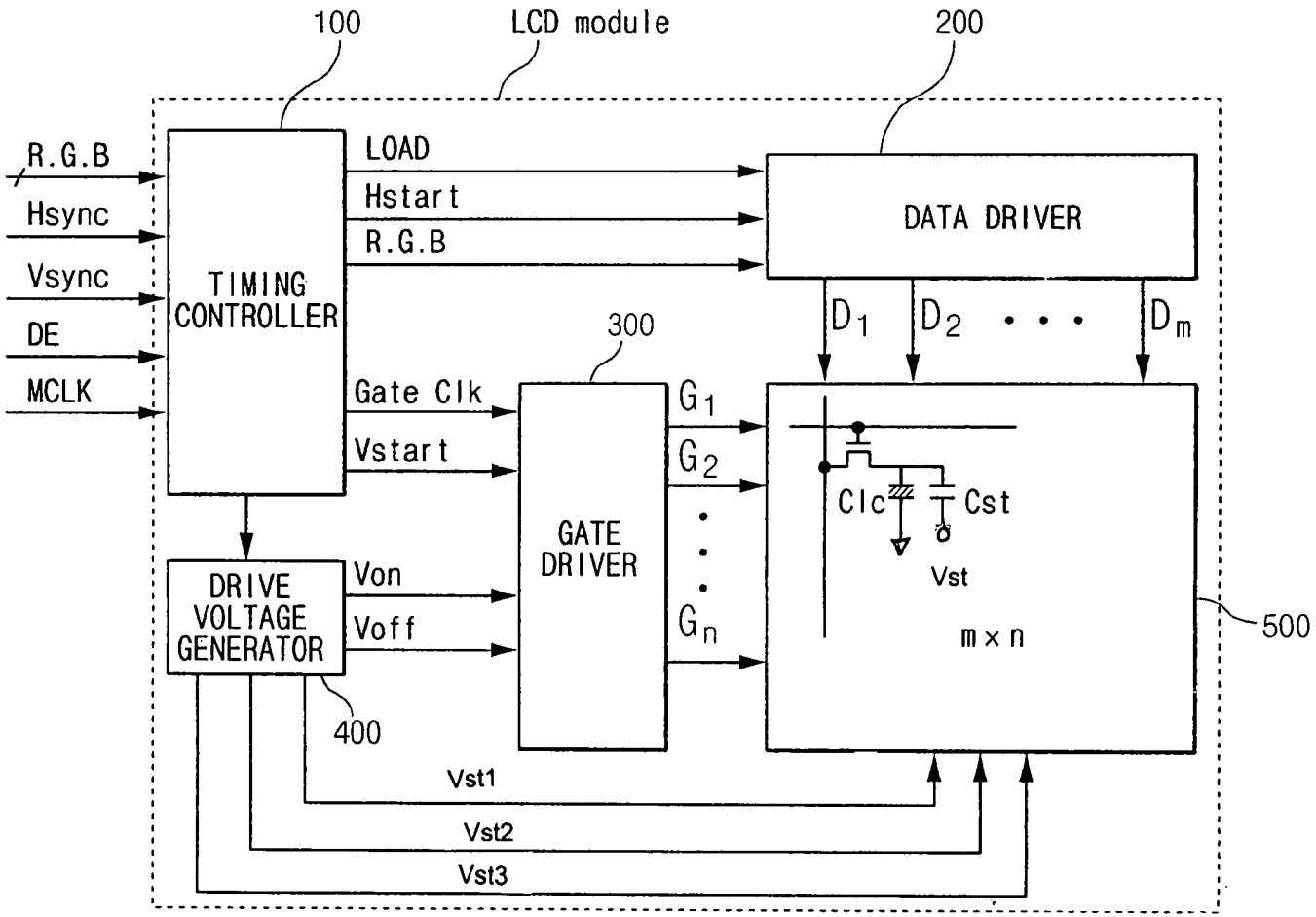
FIG. 10 is a schematic view of an LCD using a reverse mode swing common electrode voltage according to a second preferred embodiment of the present invention.

FIG. 10 shows a schematic view of an LCD using a reverse mode swing common electrode voltage according to a second preferred embodiment of the present invention.

As shown in the drawing, the LCD includes a timing controller 100, a data driver 200, a gate driver 300, a drive voltage generator 400, and an LCD panel 500. The timing controller 100 outputs data drive driving signals (LOAD, Hstart, R, G, B) and gate driver drive signals (Gate Clk, Vstart) to the data driver 200 and the gate driver 300, respectively. Also, the timing controller 100 outputs a first signal, which determines a period and an amplitude of a common electrode voltage Vcom, to the drive voltage generator 400 according to signals received externally, which include a vertical synchronization signal Vsync, a horizontal synchronization signal Hsync, and a main clock signal MCLK.

The data driver 200, based on the data driver drive signals (LOAD, Hstart, R, G, B), outputs data drive voltages (D1, D2, . . . . Dm), which drive a polarity of a liquid crystal capacitor Clc, to a plurality of data lines. Here, the data lines are arranged in a vertical direction (in the drawing) of the LCD panel 500. The gate driver 300, based on the gate driver drive signals (Gate Clk, Vstart) supplied from the timing controller 100 and Von and Voff supplied from the drive voltage generator 400, outputs gate drive voltages (G1, G2, . . . Gn) to a plurality of gate lines. Here, the gate lines are arranged in a horizontal direction (in the drawing) of the LCD panel 500.

The drive voltage generator 400 receives the first signal, which determines the period and amplitude of the common electrode voltage Vcom as described above, and either increases or decreases a voltage level of the first signal. Also, the drive voltage generator 400 outputs the common electrode voltage Vcom to the LCD panel 500. In the present invention, there are first, second and third common electrode voltages Vcom1, Vcom2 and Vcom 3, and the first, second and third common electrode voltages Vcom1, Vcom2 and Vcom 3 swing by synchronizing to a predetermined period with respect to the gate drive voltages (G1, G2, . . . Gn).

The LCD panel 500 includes the plurality of gate lines for transmitting scanning signals; the plurality of data lines, which cross the gate lines and transmit image signals; switching elements (TFTs), which are formed in regions defined by the crossing of the gate lines and the data lines and are connected to the same; the liquid crystal capacitor Clc for transmitting a light provided by a back light (not shown) according to an "on" operation of the switching element, the light being in proportion to the data drive voltages (D1, D2, . . . Dm); and a storage capacitor Cst for accumulating the data drive voltages (D1, D2, . . . Dm) when the switching element is on, and applying the stored voltages to the liquid crystal capacitor Clc when the switching element is off.

In operation, the LCD panel 500 displays the image signals supplied from the data driver 200 based on the first, second and third common electrode voltages Vcom1, Vcom2 and Vcom 3. Common electrode lines are arranged on the LCD panel 500 such that they receive one of the three common electrode voltages Vcom1, Vcom2 and Vcom 3 from the drive voltage generator 400. That is, a first common electrode line receives the first common electrode voltage Vcom1, a second common electrode line receives the second common electrode voltage Vcom2, a third common electrode line receives the third common electrode voltage Vcom3, and a fourth common electrode line receives the first common electrode voltage Vcom1. Although the second preferred embodiment was described with three common electrode voltages, it is also possible to use different numbers of common electrode voltages such as two or four.

Figure 11:
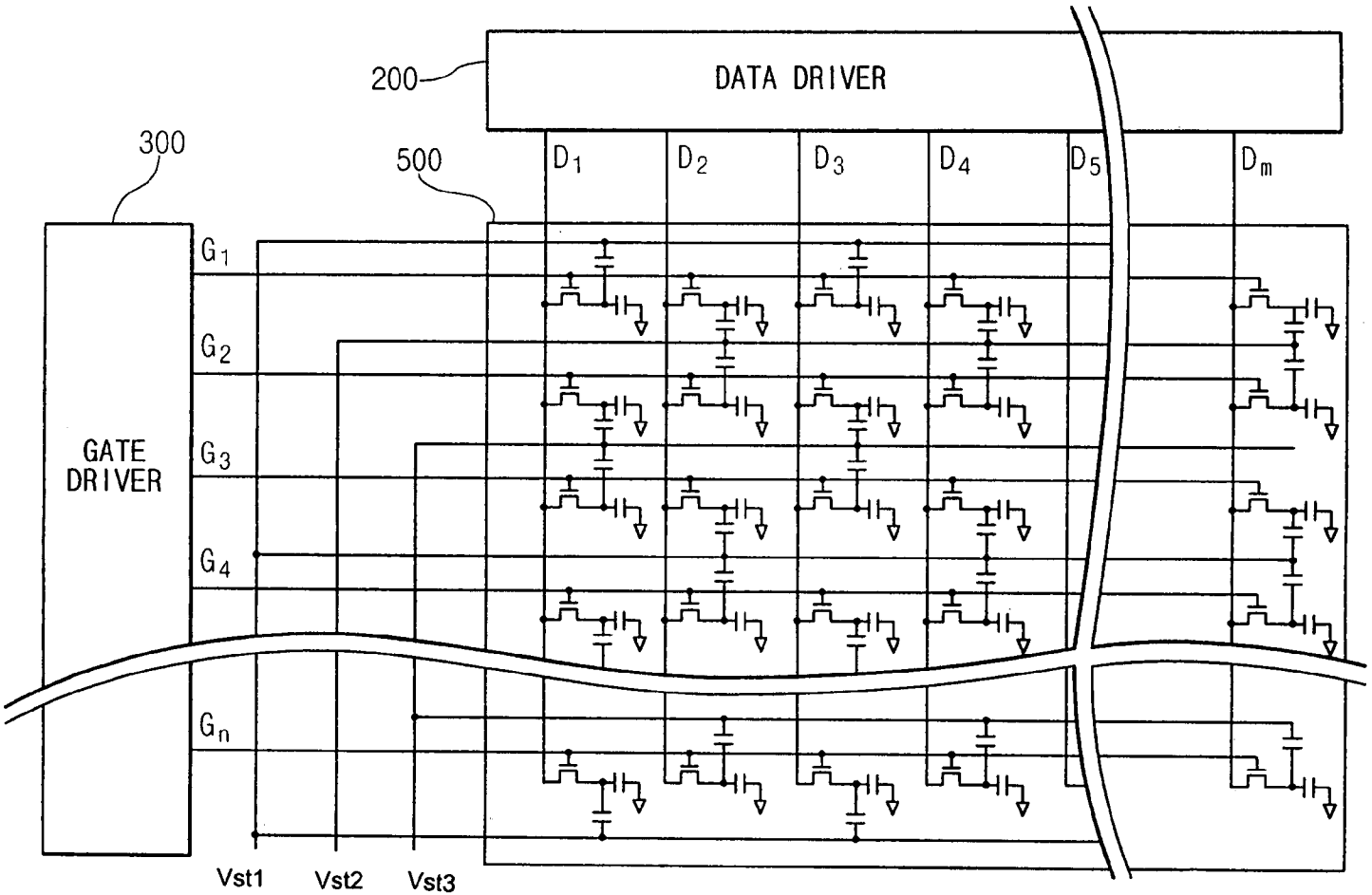
FIG. 11 is a schematic view of an equivalent circuit of the LCD of FIG. 10.

FIG. 11 shows a schematic view of an equivalent circuit of the LCD of FIG. 10.

As shown in the drawing, the gate lines, which are arranged horizontally (in the drawing), are connected to a single common electrode line. Also, a single common electrode line is arranged between the gate lines. There are three common electrode lines, which apply the first, second and third common electrode voltages Vcom1, Vcom2 and Vcom 3. The first common electrode voltage Vcom1 is applied to the liquid crystal capacitor on the first line, the second common electrode voltage Vcom2 is applied to the liquid crystal capacitor on the second line, and the third common electrode voltage Vcom3 is applied to the liquid crystal capacitor on the third line.

Further, a first terminal of the switching elements is connected to the gate lines, a second terminal of the switching elements is connected to the data lines, a third terminal of the switching elements is connected to one end of the liquid crystal capacitors, which are connected to one end of the storage capacitors. Connections of the other ends of the liquid crystal capacitors are as follows. The other ends belonging to the liquid crystal capacitors positioned at odd lines and odd columns are connected to the common electrode lines, which are positioned at upper ends of the gate lines to which the switching elements are connected; and the other ends belonging to the liquid crystal capacitors and positioned at even lines and even columns are connected to lower ends of the gate lines to which the switching elements are connected. The other ends of the liquid crystal capacitors can also be connected in the opposite manner.

Only one example of the application of the three common electrode voltages Vcom1, Vcom2 and Vcom 3 through the plurality of common electrode lines, which are arranged with and between the gate lines and bundled in three portions in a left portion of the LCD panel, has been described. However, it is possible for the common electrode lines to be arranged and bundled at a right portion of the LCD panel. Further, it is also possible for the common electrode lines to be arranged and bundled on both left and right portions of the LCD panel.

In the second preferred embodiment of the present invention as described above, the common electrode voltage output by the drive voltage generator 400 is applied to the common electrode lines formed horizontally on the LCD panel 500 to generate an overshoot. Accordingly, a response speed of the LCD is improved.

Figure 12:
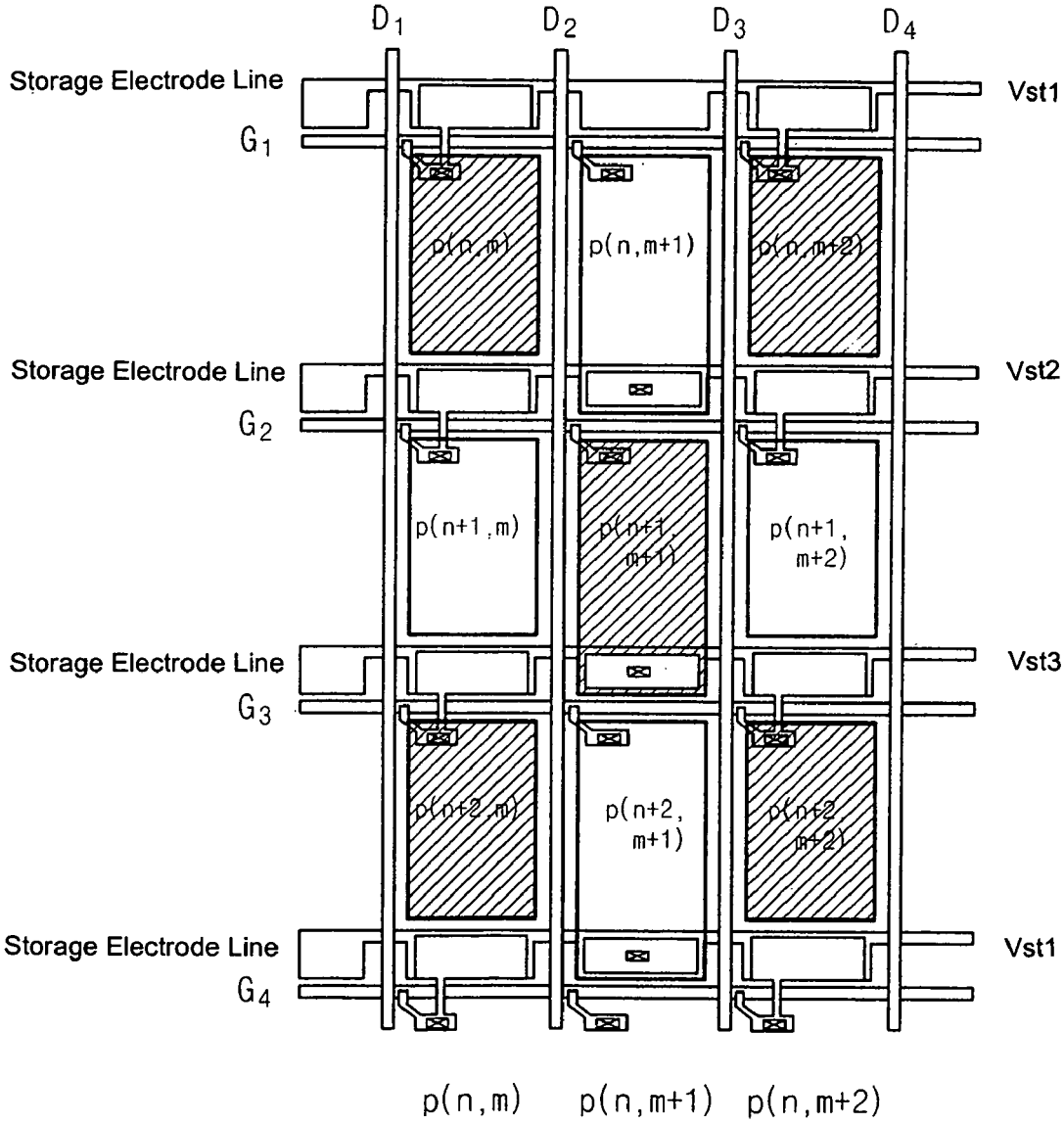
FIG. 12 is a schematic view used to describe a single common line wiring structure in dot inversion according to a second preferred embodiment of the present invention.

FIG. 12 is a schematic view used to describe a single common line wiring structure in dot inversion according to the second preferred embodiment of the present invention.

Common electrode lines are laid out horizontally (in the drawing). Odd gate lines (G1, G3, . . . ) are formed adjacent to odd common electrode lines and therefore are laid out horizontally, and even gate lines (G2, G4 . . . ) are formed adjacent to even common electrode lines and therefore are laid out horizontally. Data lines (D1, D2, D3, D4 . . . ) are provided vertically (in the drawing).

Further, first storage capacitors connect the odd common electrode lines to the odd gate lines (G1, G3, . . . ) in regions divided by the odd data lines (D1, D3, . . . ) and the even data lines (D2, D4, . . . ). The first storage capacitors also connect the even common electrode lines to the even gate lines (G2, G4, . . . ) in regions divided by the odd data lines (D1, D3, . . . ) and the even data lines (D2, D4 . . . ). Second storage capacitors connect the even common electrode lines to the odd gate lines (G1, G3, . . . ) in regions divided by the even data lines (D2, D4, . . . ) and the odd data lines (D1, D3, . . . ). The second storage capacitors also connect the even common electrode lines to the even gate lines (G2, G4, . . . ) in regions divided by the even data lines (D2, D4, . . . ) and the odd data lines (D1, D3, . . . ).

Various common electrode voltages—first, second and third common electrode voltages Vcom1, Vcom2 and Vcom 3 in the present invention—are applied to the common electrode lines of the LCD panel of the above. That is, the first common electrode voltage Vcom1 is applied to a first common electrode line, the second common electrode voltage Vcom2 is applied to a second common electrode line, the third common electrode voltage Vcom 3 is applied to a third common electrode line, and the first common electrode voltage Vcom1 is also applied to a fourth common electrode line.

Figure 13:
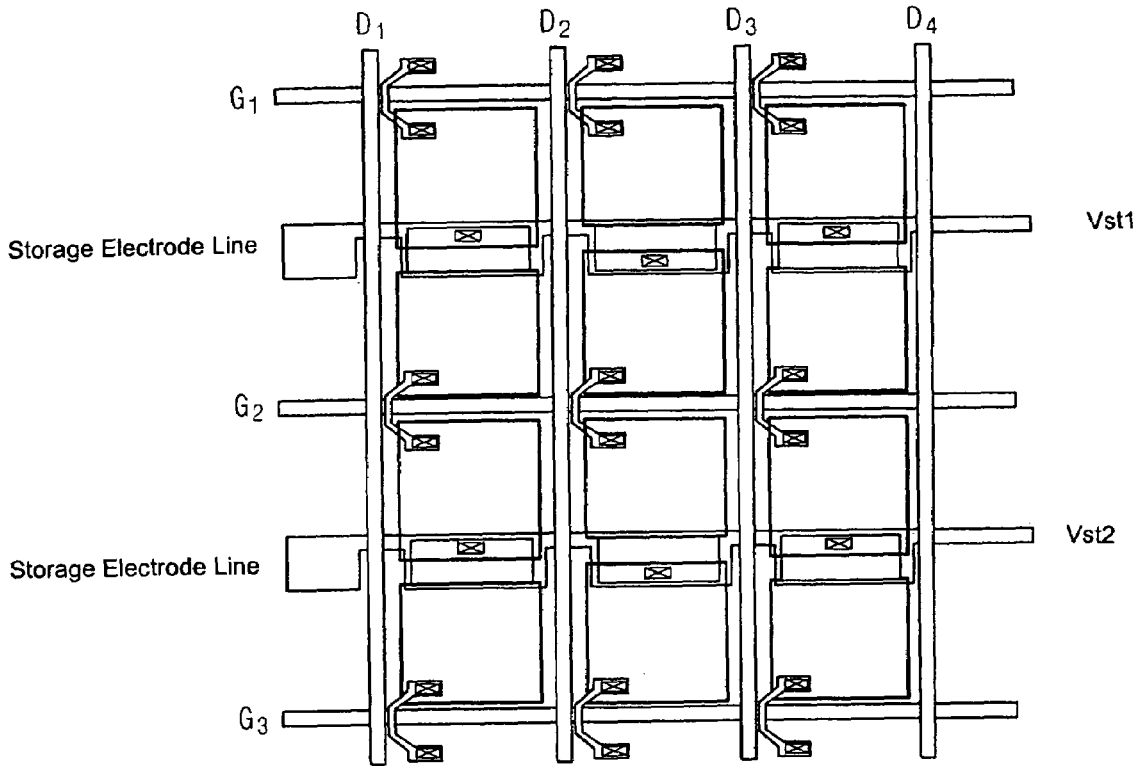
FIG. 13 is a schematic view used to describe a divided pixel structure in dot inversion according to a second preferred embodiment of the present invention.

FIG. 13 shows a schematic view used to describe a divided pixel structure in dot inversion according to the second preferred embodiment of the present invention.

As shown in the drawing, common electrode lines are arranged horizontally (in the drawing) between gate lines. A first pixel is formed in a region formed by odd gate lines (G1, G3, . . . ) and even gate lines (G2, G4, . . . ), and by odd data lines (D1, D3, . . . ) and even data lines (D2, D4, . . . ). One end of the first pixel is connected to the odd gate lines (G1, G3, . . . ), and its other end is connected to the common electrode lines. A second pixel is formed in a region formed by the odd gate lines (G1, G3, . . . ) and the even gate lines (G2, G4, . . . ), and by the odd data lines (D1, D3, . . . ) and the even data lines (D2, D4, . . . ). One end of the second pixel is connected to the even gate lines (G2, G4 . . . ). A third pixel is formed in a region formed by the odd gate lines (G1, G3, . . . ) and the even gate lines (G2, G4, . . . ), and by the even data lines (D2, D4, . . . ) and the odd data lines (D1, D3, . . . ). One end of the third pixel is connected to the odd gate lines (G1, G3, . . . ). A fourth pixel is formed in a region formed by the odd gate lines (G1, G3, . . . ) and the even gate lines (G2, G4, . . . ), and by the even data lines (D2, D4, . . . ) and the odd data lines (D1, D3, . . . ). One end of the fourth pixel is connected to the common electrode lines and its other end is connected to the even gate lines (G2, G4, . . . ).

Various common electrode voltages—first, second and third common electrode voltages Vcom1, Vcom2 and Vcom 3 in the present invention—are applied to the common electrode lines of the LCD panel of the above. That is, the first common electrode voltage Vcom1 is applied to a first common electrode line, the second common electrode voltage Vcom2 is applied to a second common electrode line, the third common electrode voltage Vcom3 is applied to a third common electrode line, and the first common electrode voltage Vcom1 is also applied to a fourth common electrode line.

To operate the above LCD using a dot inversion drive method, pixels are divided on both sides of the gate lines. Here, separation between the gate lines and the common electrode lines reduces defects caused by a line short.

In the embodiments as described above, the common electrode lines are arranged between the horizontally provided gate lines enhancing the response speed of liquid crystals. However, it is also possible, if necessary to reduce an aperture ratio, to arrange the common electrode lines between the vertically provided data lines.

In the first embodiment of the present invention described above, when driving the common electrode voltage, because of the limit to the swing width to which swinging of the common electrode voltage must be performed, overshoot is small. Accordingly, only minor response speed improvements are realized. However, in the second preferred embodiment of the present invention, a swing width of at least four times greater than that obtained in the first embodiment is realized, thereby greatly improving the response speed of liquid crystals. Further, in the second embodiment, an enhanced response speed is achieved with the application of a dot inversion structure without modification.

Although preferred embodiments of the present invention have been described in detail hereinabove, it should be clearly understood that many variations and/or modifications of the basic inventive concepts herein taught that may appear to those skilled in the present art will still fall within the spirit and scope of the present invention, as defined in the appended claims.

What is claimed is:

1. A method for driving a liquid crystal display (LCD), comprising steps of:

turning on a gate electrode for a first predetermined period, wherein a gate voltage does not swing after the first predetermined period for a second predetermined period;

changing a polarity of a pixel voltage from a first polarity to a second polarity during the first predetermined period;

swinging a common electrode voltage after the first predetermined period for the second predetermined period; and swinging the pixel voltage from said first polarity to said second polarity, and then, from said second polarity to said first polarity during the second predetermined period, wherein the pixel voltage and the common electrode voltage swing in synchronization during the second predetermined period, and a swinging width of the common electrode voltage is different from that of the pixel voltage.

2. The method of claim 1, wherein a polarity of the common electrode voltage is maintained during the first predetermined period.

3. The method of claim 2, wherein the common electrode voltage maintains said first polarity during the first predetermined period.

4. The method of claim 2, wherein the common electrode voltage maintains said second polarity during the first predetermined period.

5. The method of claim 1, wherein the swinging width of the common electrode voltage is between 12 V to 25 V.

6. The method of claim 1, the LCD is driven by a dot inversion method.

7. A display device, comprising:

a timing controller receiving a synchronization signal and a clock signal and generating a data drive signal, a gate drive signal and a common electrode signal;

a data driver receiving the data drive signal and generating a data voltage;

a gate driver receiving the gate drive signal and generating a gate voltage;

a common signal generator receiving the common electrode signal and generating at least two different common electrode voltages; and a plurality of pixels formed in a matrix, each pixel comprising:

a pixel electrode;

a switching element supplying the data voltage to the pixel electrode in response to the gate voltage; and a common electrode receiving one of the common electrode voltages, wherein the data voltage supplied to the pixel electrode and the common electrode voltage supplied to the common electrode form a liquid crystal capacitance, wherein, in each pixel, a polarity of a pixel voltage changes from a first polarity to a second polarity while the switching element is turned on for a first predetermined period by the gate voltage, the gate voltage does not swing after the first predetermined period for a second predetermined period, the common electrode voltage swings after the first predetermined period for the second predetermined period, the pixel voltage swings from said first polarity to said second polarity, and then, from said second polarity to said first polarity during the second predetermined period, the pixel voltage and the common electrode voltage swing in synchronization during the second predetermined period, and a swinging width of the common electrode voltage is different from that of the pixel voltage.

8. The display device of claim 7, wherein the common electrode voltage maintains the same polarity for the first predetermined period.

9. The display device of claim 8, wherein the common electrode voltage maintains said first polarity for the first predetermined period.

10. The display device of claim 8, wherein the common electrode voltage maintains said second polarity for the first predetermined period.

11. The display device of claim 8, further comprising:

a plurality of gate lines extending in a first direction and transmitting the gate voltage;

a plurality of data lines extending in a second direction and transmitting the data voltage; and a plurality of common electrode lines transmitting the common electrode voltages, each common electrode line formed between two neighboring gate lines, wherein each switching element has a first terminal connected to a corresponding gate line and a second terminal connected to a corresponding data line, and each common electrode is connected to a corresponding common electrode line.

12. The display device of claim 11, wherein the common electrodes of two adjoining pixels are connected to two different common electrode lines, respectively.

13. The display device of claim 12, wherein the display device is driven in a dot inversion method.

14. The display device of claim 11, wherein the common electrode lines are divided into a first group and a second group, wherein the common electrode lines of the first group and the common electrode lines of the second group are alternately arranged.

15. The display device of claim 14, wherein each of the pixels arranged on the odd rows and the odd columns and the even rows and the even columns has the common electrode connected to the common electrode line of the first group, and each of the pixels arranged on the odd rows and the even columns are the even rows and the even columns has the common electrode connected to the common electrode line of the second group.

16. The display device of claim 7, wherein the swinging width of the common electrode voltage is between 12 V to 25 V.

17. A method of driving a liquid crystal display (LCD), comprising steps of:

providing a gate voltage to a gate electrode to turn on the gate electrode for a first predetermined period, wherein the gate voltage does not swing after the first predetermined period for a second predetermined period;

providing a data voltage to a pixel electrode in response to the gate voltage; and providing a common voltage to a common electrode, the common voltage swinging after the first predetermined period for the second predetermined period, wherein a polarity of a pixel voltage changes from a first polarity to a second polarity during the first predetermined period, the pixel voltage swings from said first polarity to said second polarity, and then, from said second polarity to said first polarity during the second predetermined period, the pixel voltage and the common electrode voltage swing in synchronization during the second predetermined period, and a swinging width of the common electrode voltage is different from that of the pixel voltage.

18. The method of claim 17, wherein the swinging width of the common electrode voltage is between 12 V and 25 V.

19. The method of claim 17, the LCD is driven by a dot inversion method.

* * * * *